United States Patent [19]

Boyle

[11] 4,437,618

[45] Mar. 20, 1984

[54] SPOOL DISPENSER

[75] Inventor: Daniel J. Boyle, Hartland, Wis.

[73] Assignee: Champion International Corporation, Stamford, Conn.

[21] Appl. No.: 396,164

[22] Filed: Jul. 8, 1982

[51] Int. Cl.[3] ..... B65H 75/18; B65H 75/14

[52] U.S. Cl. ..... 242/71.8; 206/49; 206/395; 242/118.4; 242/118.8

[58] Field of Search ..... 242/50, 61, 71.8, 222, 242/118, 118.4, 118.8; 206/49, 388, 389, 395, 396

[56] References Cited

U.S. PATENT DOCUMENTS

| | | | |
|---|---|---|---|
| 2,852,206 | 9/1958 | Bolding | 242/118.8 |
| 3,104,077 | 9/1963 | Struble | 242/118.8 |
| 3,838,602 | 10/1974 | Hanson et al. | 242/118.8 |
| 3,971,527 | 7/1976 | Maye | 242/118.7 |
| 4,019,692 | 4/1977 | Hanson | 242/71.8 |

*Primary Examiner*—Leonard D. Christian
*Attorney, Agent, or Firm*—Evelyn M. Sommer

[57] ABSTRACT

A spool dispenser made from a one piece blank which is folded and adhered to form front, rear walls and side walls as well as top and bottom walls. The spool dispenser is adapted to lie flat until it is to be used and may be provided with separation teeth to separate the articles which are to be wound therearound.

21 Claims, 7 Drawing Figures

SPOOL DISPENSER

BACKGROUND OF THE INVENTION

The present invention relates to a spool dispenser and more particularly to an improved spool dispenser for wrapping thin, elongated flexible materials, such as trimming, garland, yarn, ribbon, string, wire and the like. For ease in description, the invention will be described with reference to a spool for trimming. However, it will be understood that the word "trimmings" as used herein is intended to include trimmings, ribbon, wire, garland and any other elongated flexible material which is adapted to be wrapped around the spool.

Heretofore, trimmings have been wrapped or wound around spools which are made of a paperboard material. These spools are used for neatly keeping the trimmings in place until they are to be used. In some instances, the spools are intended to be discarded after use, however, other types of spools are adapted to be reused in the future.

Heretofore, such spools have been bulky so that it has been difficult to store them and to manufacture them by automatic machinery. Furthermore, such spools are not easily able to be flattened for storage and shipment and to be easily assembled to an operative set-up condition. In addition, such spools are not durable, stable and reusable. Moreover, such spools are not provided with separation tips for use with thin trimmings.

BRIEF DESCRIPTION OF THE INVENTION

The present invention has for one of its objects the provision of an improved spool dispenser which may be formed from a single blank.

Another object of the present invention is the provision of an improved spool dispenser which may be stored and shipped flat until it is to be used.

Another object of the present invention is the provision of an improved spool dispenser which may be manufactured by automatic machinery.

Another object of the present invention is the provision of an improved spool dispenser which may be easily assembled to a set-up usable condition.

Another object of the present invention is the provision of an improved spool dispenser having a double thickness top and end walls to give it stability, durability and reusability.

Another object of the present invention is the provision of an improved spool dispenser having separation tips to separate the product being wrapped on the spool.

Other and further objects of the invention will be obvious upon an understanding of the illustrative embodiment about to be described, or will be indicated in the appended claims, and various advantages not referred to herein will occur to one skilled in the art upon employment of the invention in practice.

Briefly, the invention includes a spool made from a one piece blank having a front wall panel and a rear wall panel. A side flap extends from the outer edges of each front and rear wall panel and a side flap extends from the inner edges of the front and rear wall panels. A side wall panel is interposed between the inner side flaps and is foldable relative thereto along a fold line. A second side wall panel extends from the outer side flap panel and is foldable relative thereto along a fold line. In this manner, the spool dispenser is adapted to lie flat until it is to be used. If desired, the spool may be provided with separation tips to separate the articles which are to be wound therearound.

BRIEF DESCRIPTION OF THE DRAWINGS

A preferred embodiment of the invention has been chosen for purposes of illustration and description and is shown in the accompanying drawings forming a part of the specification, wherein.

DETAILED DESCRIPTION OF THE INVENTION

Figure 1:
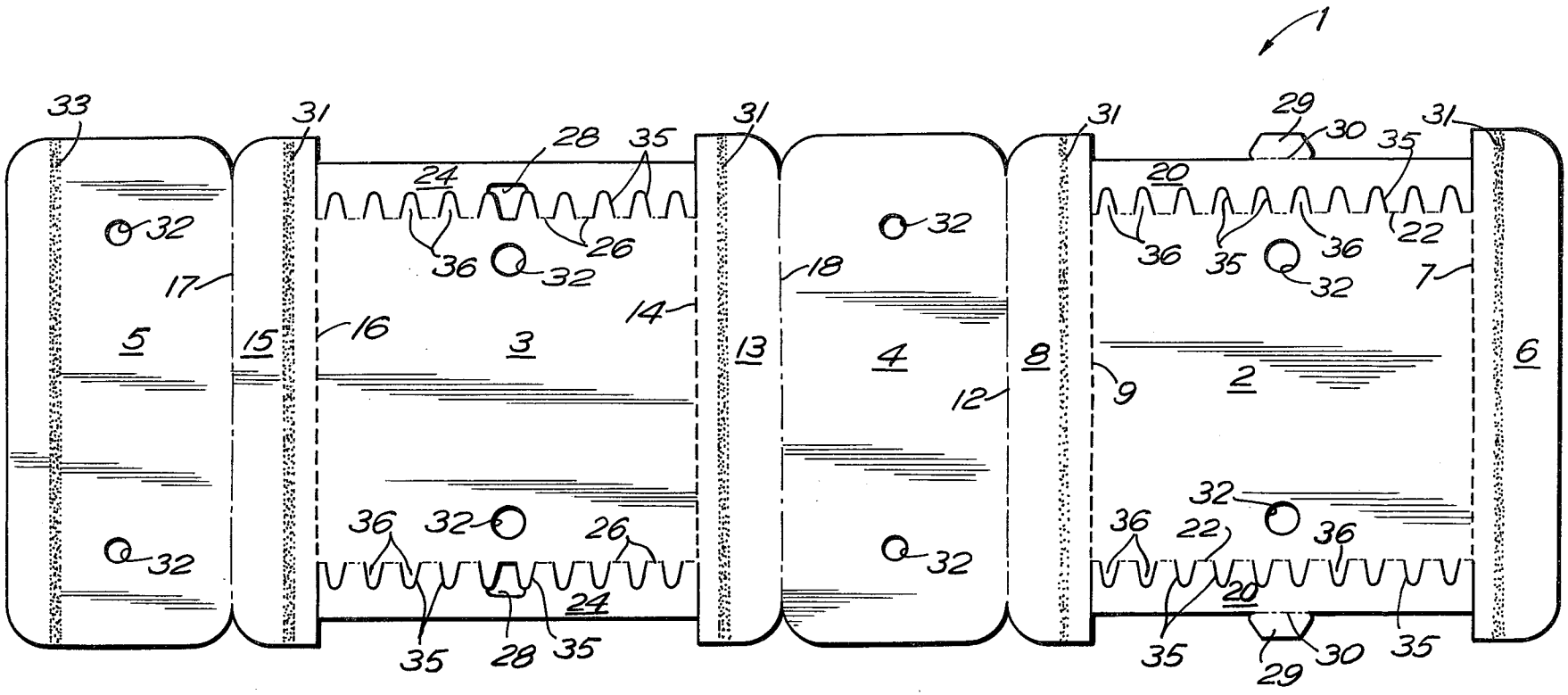
FIG. 1 is a plan view of the blank used in connection with the present invention.
Figure 2:
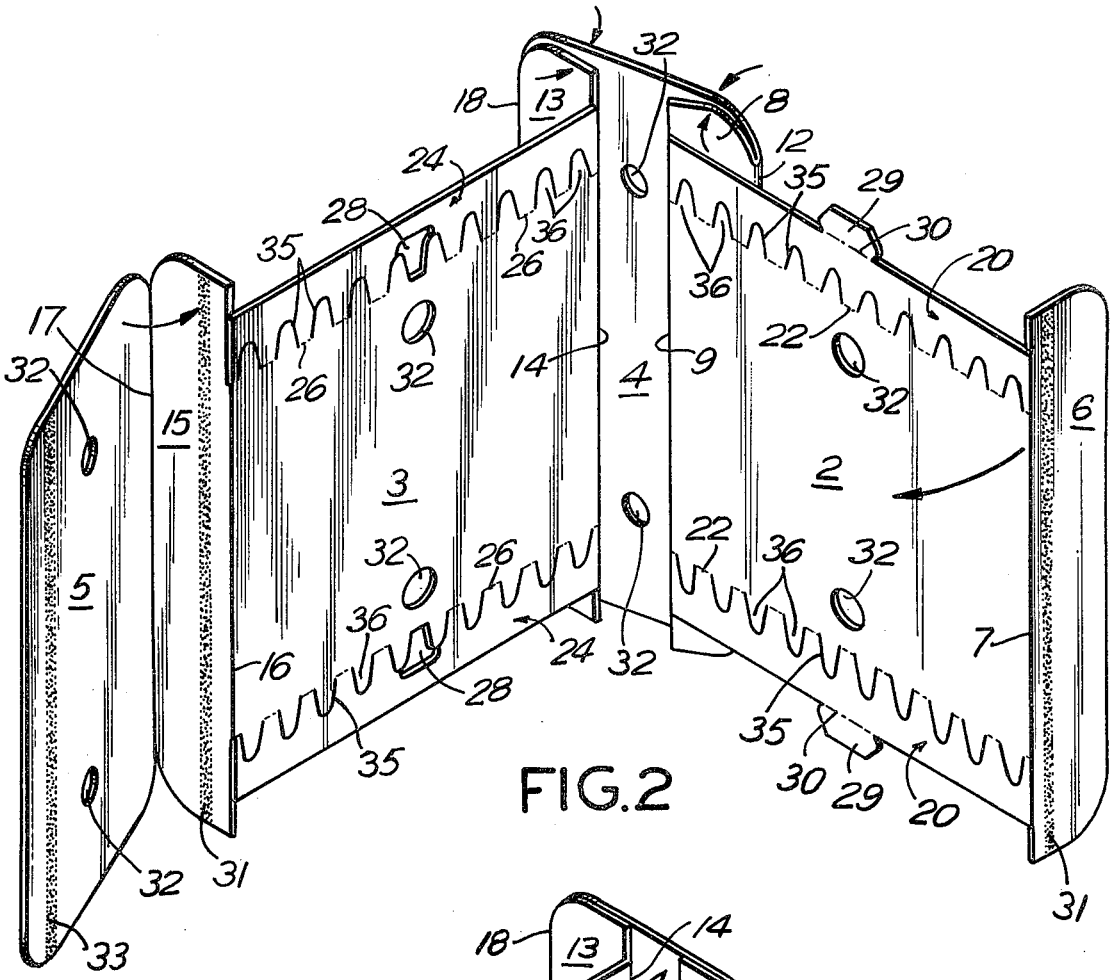
FIG. 2 is a perspective view of the blank shown in the process of being folded to its assembled condition.

Referring to the drawing, and more particularly to FIG. 1, the blank 1 of the present invention may be made from a single piece of diecut and scored paperboard material and comprises a pair of front and rear wall panels 2 and 3, respectively, and a pair of side wall panels 4 and 5, respectively. The front wall panel 2 has side flaps 6 and 8 extending from its outer edges and foldable relative thereto along fold lines 7 and 9. The side flap 8 is connected to and foldable relative to the side wall panel 4 along a fold line 12.

The rear wall panel 3 is provided with a pair of side flaps 13 and 15 extending from its outer edges and foldable relative thereto along fold lines 16 and 18. The side flap 13 is connected to and foldable relative to the side wall panel 5 along fold line 17.

The front wall panel 2 has top and bottom wall panels 20 extending therefrom and foldable relative thereto along fold lines 22. The rear wall panel 3 has top and bottom wall panels 24 extending therefrom and foldable relative thereto along fold lines 26. The top and bottom wall panels 24 of the rear wall panel 3 has centrally located locking openings 28 therein and the top and bottom wall panel 20 of the front wall panel 2 has centrally located locking tabs 28 extending therefrom and foldable relative thereto along fold line 30 which are adapted to be inserted into the locking openings 28 to maintain the spool 1 in its assembled position.

Preferably, the side flap panels 8–18 and 6–15 are approximately the same height as the side wall panels 4 and 5, although it is within the purview of the invention to make them shorter than side walls 4 and 5. In addition, the side flap panels 8–18 and 6–15 preferably are of equal width and preferably the combined width of each pair of side flaps 8–18 and 6–15 is narrower than the width of the side wall panels 4 and 5 so that the inner edges 9–14 and 7–16 of each side flap pair 8–18 and 6–15, respectively, are spaced from each other when the spool dispenser is assembled. This enables the front and rear walls 2 and 3 to be spaced from each other when the spool is assembled.

In addition, preferably, the width of top and bottom walls 20 and 24 are equal to the space between the inner edges 9–14 and 7–16 of each side flap panels 8–18 and 6–15, respectively, so that they will span the space between the front and rear walls 2 and 3 when they are folded over. It will be understood that, if desired, it is within the purview of the invention to make the depth of each of the side wall flaps 8–13 and 6–15 approximately half the depth of the side wall panels 4–15 so that there is no space between edges 9–14 and 7–16 of the side flap panels 4–5 and no space between the front and rear walls 2 and 3, in which event the top and bottom walls could be eliminated.

Areas of adhesive 31 are applied on the side flaps 6, 8, 13 and 15 and may also be provided on the side wall panel 5, as at 33, if desired. Openings 32 may also be provided in the front and rear wall panels 2 and 3 and in the side wall panels 4 and 5 to permit the completed spool to be hung for display or storage purposes.

Figure 4:
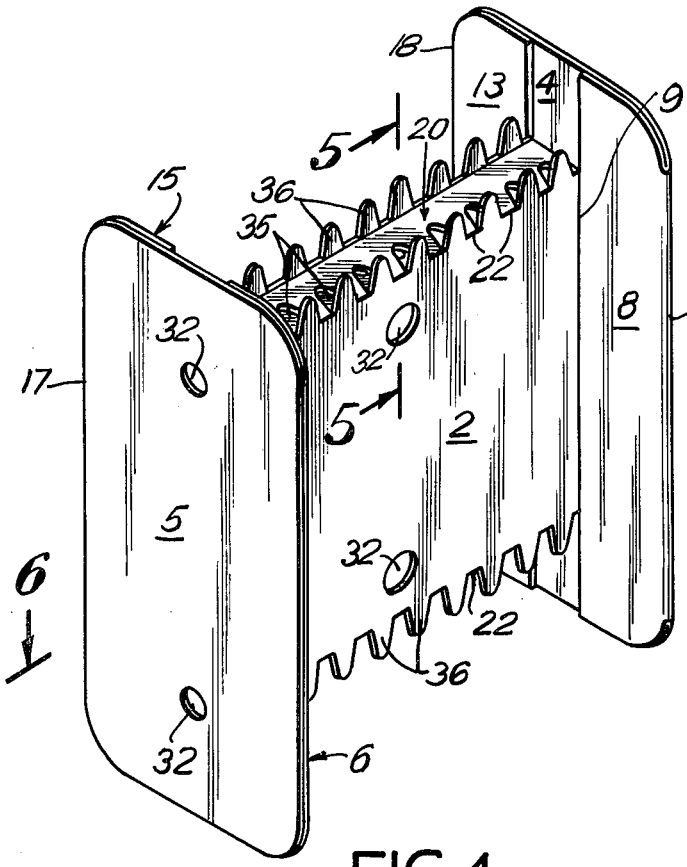
FIG. 4 is a perspective view showing the spool in its fully assembled condition ready to be used.

In the preferred embodiment of the invention, the top and bottom wall flaps 20 and 24 are provided with spaced arcuate cutout portions 35 which start at the fold lines 22 and 26 and extend across the top and bottom wall panels 20–24. Hence, when the top and bottom wall panels 20 and 24 are folded over along fold lines 22 and 26, as shown in FIG. 4, upstanding spaced teeth 36 are formed to separate the trimming that will be wound around the spool. However, if desired, it will be understood that the teeth 36 may be eliminated without departing from the purview of the invention.

In assembling the blank 1 to form the spool of the present invention, the side wall flaps 8 and 13 are folded over the side wall panel 4 along fold lines 12 and 18 and adhered thereto along the adhesive areas 31. The other side flaps 6 and 15 are also folded relative to the front and rear wall panels 2 and 3 along fold lines 7 and 16 and, with side flap 15 folded along line 17 relative to side wall panel 5, are superimposed over the side wall panel 5 and adhered thereto along adhesive lines 31 and 33 in order to form the spool as shown in FIG. 3.

The front and rear walls 2 and 3 are spaced apart a distance equal to the distance between the edges 9–14 and 7–16 of each pair of side wall flaps 18–13 and 6–15 and the top and bottom walls 20–24 are of a similar width and will bridge the space between the front and rear walls. It will be understood that if the width of the side flap panels 8–13 and 6–15 are changed, the distance between the front and rear walls 2 and 3 will be changed correspondingly and the depth of the top and bottom walls 20–24 would also have to be changed correspondingly.

Figure 3:
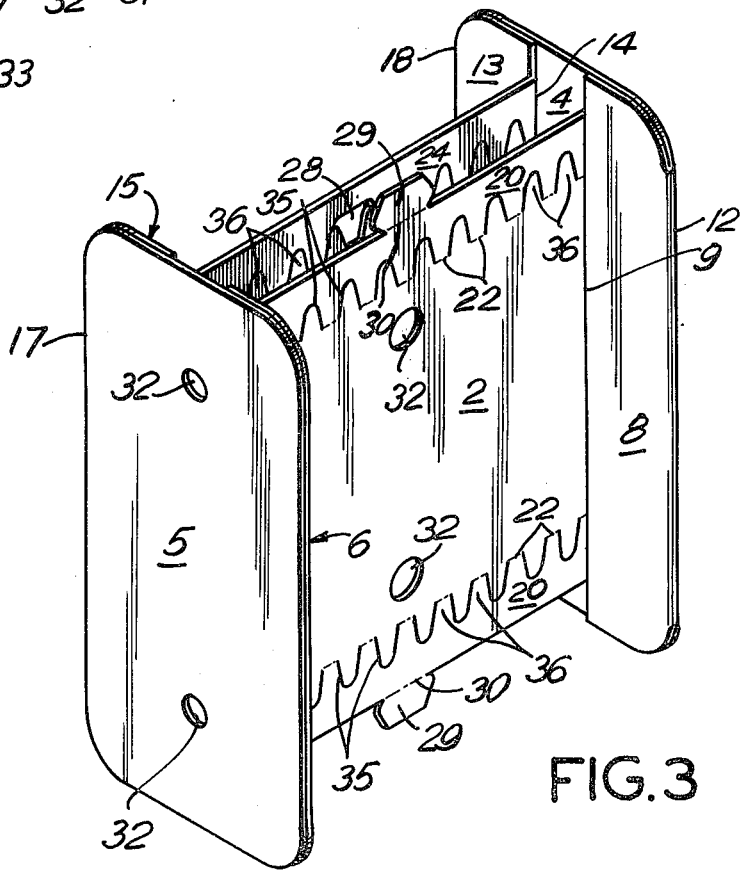
FIG. 3 is a perspective view of the blank in its assembled condition.
Figure 7:
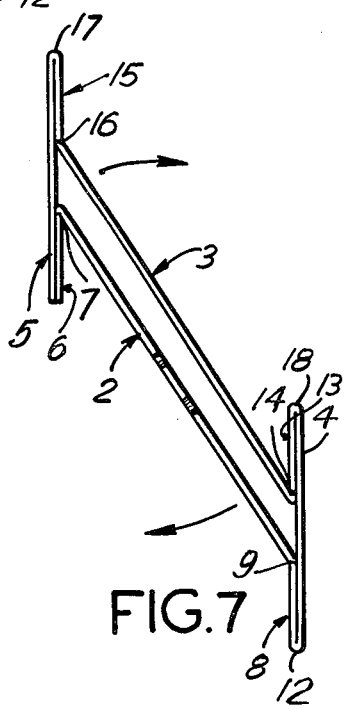
FIG. 7 is a top plan view of the unit as shown in FIG. 3 showing the manner in which the spool may be folded into a flattened condition for shipment, storage and future usage.
Figure 6:
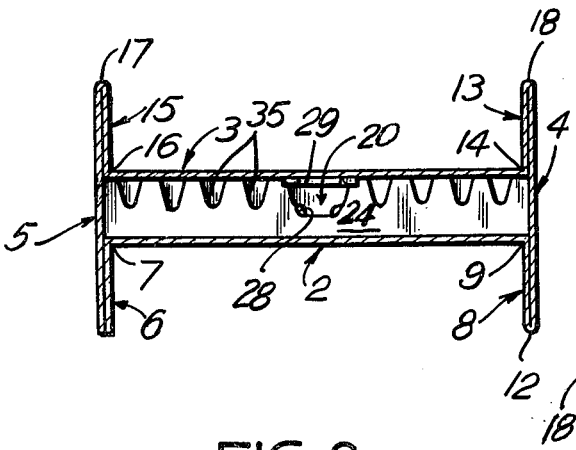
FIG. 6 is a sectional view taken along line 6—6 of FIG. 4.
Figure 5:
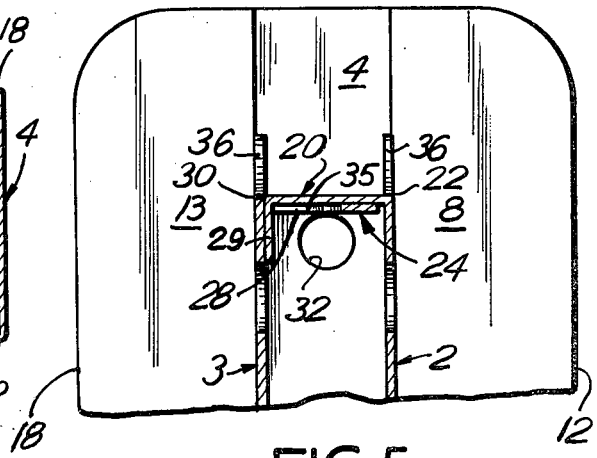
FIG. 5 is a sectional view taken along line 5—5 of FIG. 4.

In the position shown in FIG. 3, before the top and bottom walls are folded down, the spool may be folded along the fold lines 7, 9, 14 and 19, as shown in FIG. 7, so that the spool 1 may lie flat for storage and shipment. When the spool is to be used, the spool 1 is set-up and unfolded along fold lines 7–9 and 14–16. The top and bottom wall panels 20 and 24 are folded inwardly over each other along fold lines 22 and 26, as shown in FIG. 4, and the lock tabs 29 are inserted into the lock openings 28 to hold the spool in its set-up position, as shown in FIG. 4. In this position, lengths of trimming, such as ribbon, garland, wire, etc., may be wound around the spool and may be separated by the teeth 36. The openings 32 may be used to hang the spool for display or storage. When the contents of the spool are depleted, the spool may again be stored in flattened position by unhooking the lock tabs 29 from the lock openings 28, enfolding the top and bottom wall panels 20–24 outwardly along fold lines 22–26 to the position of FIG. 3 and folding the unit down as shown in FIG. 7 to a flattened position.

It will thus be seen that the present invention provides an improved spool dispenser which may be stored and shipped flat until it is to be used, which may be manufactured from a single blank by automatic machinery, which can be easily unfolded to a set-up condition and which has stability, repeated consumer usage, and durability and which is provided with separation tips to separate the trimming being wrapped on the spool.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A spool dispenser blank comprising a front wall panel and a rear wall panel, a side flap extending from the outer edges of each front and rear wall panels and foldable relative thereto along a fold line and a side flap extending from each inner edge of the front and rear wall panels and foldable relative thereto along a fold line, a side wall panel interposed between the inner side flaps extending from the front and rear wall panels and foldable relative thereto along a fold line, a second side wall panel extending from the outer side flap panel and foldable relative thereto along a fold line.

2. A blank for a spool dispenser as claimed in claim 1, wherein said inner side flap panels are adapted to be folded over the first side wall panel and adhered thereto and wherein the outer side flap panels are adapted to be superimposed to the second side wall panel and adhered thereto.

3. A blank for a spool dispenser as claimed in claim 2, wherein the depth of the combined inner and outer side flap panels is less than the depth of the side wall panel to which they are adhered.

4. A blank for a spool dispenser as claimed in claim 3, wherein each front and rear wall panel has a top and a bottom wall panel foldable relative thereto along a fold line.

5. A blank for a spool dispenser as claimed in claim 4, wherein spaced cutouts are provided in said top and bottom walls whereby spaced teeth are formed when the top and bottom walls are folded over.

6. A blank for a spool dispenser as claimed in claim 5, wherein the height of said side flap panels is substantially the same as the height of said side wall panels.

7. A blank for a spool dispenser as claimed in claim 6, wherein the height of the front and rear wall panels is less than the height of the side wall panels.

8. A spool dispenser comprising a front wall panel and a rear wall panel, a side flap extending from the outer edges of each front and rear wall panels and foldable relative thereto along a fold line and a side flap extending from each inner edge of the front and rear wall panels and foldable relative thereto along a fold line, a first side wall panel interposed between the inner side flaps extending from the front and rear wall panels and foldable relative thereto along a fold line, a second side wall panel extending from the outer side flap panel and foldable relative thereto along a fold line.

9. A spool dispenser as claimed in claim 8, wherein said inner side flap panels are adapted to be folded over the first side wall panel and adhered thereto and wherein the outer side flap panels are adapted to be superimposed to the second side wall panel and adhered thereto.

10. A spool dispenser as claimed in claim 9, wherein the depth of the combined inner and outer side flap panels is less than the depth of the side wall panel to which they are adhered.

11. A spool dispenser as claimed in claim 10, wherein each front and rear wall panel has a top and a bottom wall panel foldable relative thereto along a fold line.

12. A spool dispenser as claimed in claim 11, wherein spaced cutouts are provided in said top and bottom walls whereby spaced teeth are formed when the top and bottom walls are folded over.

13. A spool dispenser as claimed in claim 12, wherein the height of said side flap panels is substantially the same height of said side wall panels.

14. A spool dispenser as claimed in claim 13, wherein the height of the front and rear wall panels is less than the height of the side wall panels.

15. A one piece spool dispenser comprising a front wall panel and a rear wall panel, a side flap extending from the outer edges of each front and rear wall panels and foldable relative thereto along a fold line and a side flap extending from each inner edge of the front and rear wall panels and foldable relative thereto along a fold line, a first side wall panel interposed between the inner side flaps extending from the front and rear wall panels and foldable relative thereto along a fold line, a second side wall panel extending from the outer side flap panel and foldable relative thereto along a fold line.

16. A one piece spool dispenser as claimed in claim 15, wherein said inner side flap panels are adapted to be folded over the first side wall panel and adhered thereto and wherein the outer side flap panels are adapted to be superimposed to the second side wall panel and adhered thereto.

17. A one piece spool dispenser as claimed in claim 16, wherein the depth of the combined inner and outer side flap panels is less than the depth of the side wall panel to which they are adhered.

18. A one piece spool dispenser as claimed in claim 17, wherein each front and rear wall panel has a top and bottom wall panel foldable relative thereto along a fold line.

19. A one piece spool dispenser as claimed in claim 18, wherein spaced cutouts are provided in said top and bottom walls whereby spaced teeth are formed when the top and bottom walls are folded over.

20. A one piece spool dispenser as claimed in claim 19, wherein the height of said side flap panels is substantially the same as the height of said side wall panels.

21. A one piece spool dispenser as claimed in claim 20, wherein the height of the front and rear wall panels is less than the height of the side wall panels.

* * * * *